US007967615B2

(12) United States Patent
Zacharevitz et al.

(10) Patent No.: US 7,967,615 B2
(45) Date of Patent: Jun. 28, 2011

(54) METHOD AND APPARATUS FOR GROUNDING AND MOUNTING A HIGH AMPERAGE SINGLE POLE CONNECTOR

(75) Inventors: Steven Daniel Zacharevitz, Melville, NY (US); John Michael Eder, Melville, NY (US)

(73) Assignee: Leviton Manufacturing Company, Inc., Melville, NY (US)

( * ) Notice: Subject to any disclaimer, the term of this patent is extended or adjusted under 35 U.S.C. 154(b) by 0 days.

(21) Appl. No.: 12/488,307

(22) Filed: Jun. 19, 2009

(65) Prior Publication Data

US 2010/0323540 A1 Dec. 23, 2010

(51) Int. Cl.
*H01R 13/648* (2006.01)

(52) U.S. Cl. ..... 439/100; 439/118; 439/365

(58) Field of Classification Search ..... 439/95, 439/100, 101, 118, 365
See application file for complete search history.

(56) References Cited

U.S. PATENT DOCUMENTS

| | | | | |
|---|---|---|---|---|
| 3,226,667 | A | 12/1965 | Senior, Jr | |
| 4,066,324 | A * | 1/1978 | Stephens | 439/581 |
| 4,316,339 | A * | 2/1982 | Herriott | 42/59 |
| 4,565,417 | A | 1/1986 | Diissel et al. | |
| 4,897,049 | A * | 1/1990 | Miller et al. | 439/365 |
| 5,048,578 | A * | 9/1991 | Dorf et al. | 141/346 |
| 5,366,392 | A | 11/1994 | Raloff et al. | |
| 6,144,557 | A * | 11/2000 | Chen et al. | 361/704 |
| 6,472,637 | B2 * | 10/2002 | Ballem | 219/205 |
| 7,559,774 | B2 * | 7/2009 | Kowalczyk | 439/95 |
| 2004/0132329 | A1 | 7/2004 | Shimoyama et al. | |
| 2006/0141844 | A1 | 6/2006 | Tufano, Jr. | |
| 2008/0045054 | A1 * | 2/2008 | Kowalczyk | 439/95 |

OTHER PUBLICATIONS

"Rhino-Hide® 49 Series Single Pole Connectors and Receptacles", Leviton Manufacturing Co., 2007.
"Single Pole Cam-Type Connectors", Leviton Manufacturing Co., 2000.
"Industrial Wiring Devices For Industrial, Commercial and OEM Applications", Leviton Manufacturing Co., IPD 2.07, 2008.
"New NEER 3WAY Screw Head" NEER Manufacturing Co., Inc. PO Box 3089, Lexington, OH 44904, 1993.

* cited by examiner

*Primary Examiner* — Truc T Nguyen
(74) *Attorney, Agent, or Firm* — Scully, Scott, Murphy & Presser, P.C.

(57) ABSTRACT

A combination grounding/mounting connector and method for mounting an electrical receptacle adapted to receive an electrical current carrying cable connector to a panel. The combination grounding/mounting connector device includes a first portion passing through an aperture formed in the receptacle and the panel for engaging a device for securing the electrical receptacle to the panel, the first portion accommodating connection to an electrical ground; and, a second portion providing an electrical ground connector when the first portion is connected to an electrical ground.

12 Claims, 5 Drawing Sheets

METHOD AND APPARATUS FOR GROUNDING AND MOUNTING A HIGH AMPERAGE SINGLE POLE CONNECTOR

BACKGROUND

Currently it is desirable for an improved electrical grounding apparatus and method for electronic systems and circuits at field installations in harsh industrial environments, e.g. an oil production rig, and the like, where there is need for secure, rugged equipment. An electrical grounding application for industrial applications employing high amperage cables and connections are typically satisfied by the provision of a grounding system, typically provided or located at a system panel receiving high-amperage cable connector.

FIG. 1 depicts a current grounding system 10 at a system panel or like panel or backboard device 15 receiving high amperage cable connector receptacles 12 used for coupling single pole electrical cable connectors. For example, the receptacle 12 depicted in FIG. 1 may be a panel mounted cable connector receptacle product including a cast-aluminum housing and a mounting base 13 shown, in the form of a square plate, having mounting apertures 17*a*, 17*b*, 17*c*, 17*d* in respective corners. A threaded mounting screw or bolt 14*a*, . . . 14*d* passes through each respective aperture and complementary threaded nuts (not shown) are used to fixedly mount the base portion 13 of the receptacle to the panel or backboard 15.

As shown in FIG. 1, one current grounding system solution 20, employs a conductive structure, e.g., a cable 20*c* and male grounding plug or pin 20*a* that may be coupled to a separate connection point, a female receptacle 20*b*, that is affixed to or integrally formed in or on the surface of the enclosure panel 15 and disposed to receive male grounding plug 20*a* for electrical coupling of a device connected to cable 20*c* to the ground. Thus, as shown in FIG. 1, underside panel 15, a further conductor couples or fastens the grounding receptacle 20*b* to electrical ground (earth). The existing solution requires more labor (i.e., during field installation) and a larger panel footprint area since the panel must accommodate both the mounted receptacle in addition to the location of the female grounding plug receptacles 20*b* formed on the panel in proximity with the receptacle 12 and taking up valuable panel real-estate.

Moreover, in current implementations, the conductor/cabling and pin 20*a* used as a grounding connection to the female ground connector receptacle 20*b* is slip-fit onto the female grounding receptacle, and can become easily disconnected by excessive vibrations and disturbances in harsh environmental and operating environments.

SUMMARY

A connector device used for mounting a first object to another object, and further which connector is configured to connect to an electrical ground.

In one embodiment, there is provided a conductive electrical grounding connector comprising a body including: a first portion adapted to mount an electrical device to a surface, the first portion is threaded and adapted to receive an electrical ground lug and fastener; and a second portion adapted to mate with a mating connector, the second portion is a single-pole connector where the single pole connector is one of a single-pole cam connector and a single pole non-cam connector In a further embodiment, there is provided a grounding system for a cable sheath. The grounding system comprising: a grounding connector disposed to mount an electrical connector receptacle to a surface, the grounding connector having a portion disposed to extend through at least a portion of the connector receptacle to engage a fastener to fixedly mount the electrical connector receptacle to the surface, and adapted to couple to an electrical ground, the grounding connector including an electrical ground contact portion; and, a grounding cable configured to electrically connect the cable sheath to the electrical ground contact portion.

Further, in accordance with this further embodiment, there is provided a method for grounding a cable sheath of a cable. The method comprises: affixing an electrical connector to a surface with a connector; placing an electrical ground lug over the a first portion of the connector; threading a nut onto the first portion of the connector to secure the electrical ground lug to the connector; connecting a cable sheath to a single-pole connector; and mating the single-pole connector to a second portion of the connector.

In each of these embodiments, the electrical ground contact of the combination grounding and mounting connector device provides a single pole male contact structure designed to mate with a cam-action single pole type female electrical connector. Alternately, the electrical ground contact provides a male contact structure designed to mate with a non-cam single pole type female electrical connector. Both the cam or a non-cam type electrical connector may be employed in the grounding system.

BRIEF DESCRIPTION OF THE DRAWINGS

The foregoing objects and advantages of the present invention may be more readily understood by one skilled in the art with reference being had to the following detailed description of several embodiments thereof, taken in conjunction with the accompanying drawings wherein like elements are designated by identical reference numerals throughout the several views, and in which.

DETAILED DESCRIPTION

Figure 2:
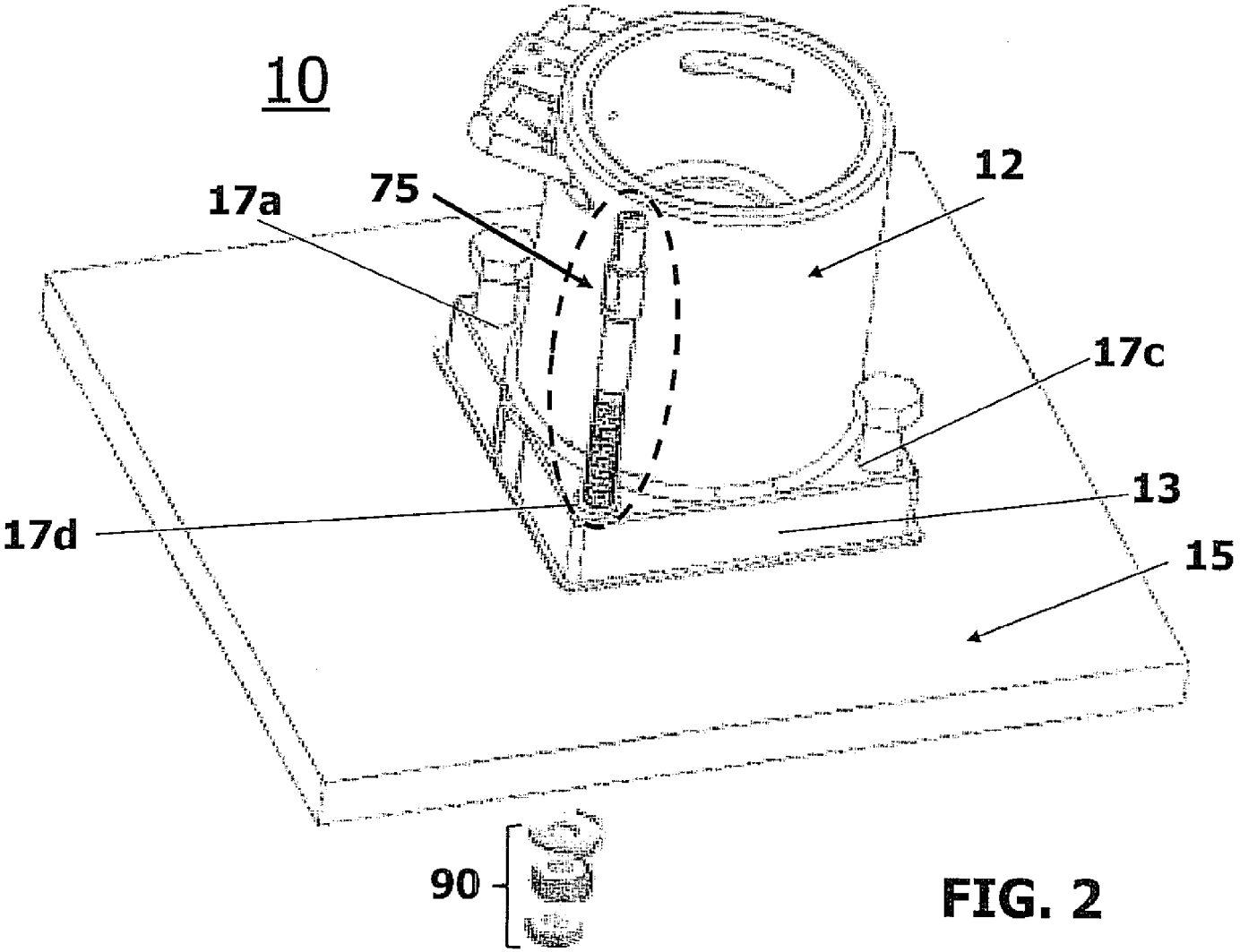
FIG. 2 is a view of a high amperage cable connector receptacle 10 including an exploded view of a mounting/grounding member 75 and fastening assembly 90 used for fastening the connector receptacle to a panel in accordance with one embodiment.

FIG. 2 illustrates a high amperage cable connector receptacle 12 shown mounted to a panel 15 in accordance with the invention. As shown in FIG. 2, the base portion 13 of the cable connector receptacle 12 includes four threaded mounting apertures (holes) 17*a*, 17*b*, 17*c*, 17*d* which receive a respective receptacle housing mounting screw or bolt for mating the receptacle 12 to the panel 15. According to an embodiment of the invention, one mounting screw or bolt 75 shown encircled in broken lines associated with one mounting aperture 17*d* in FIG. 2, functions as a combination mounting bolt and grounding member (connector). That is, mounting/grounding bolt 75 functions not only to mount the receptacle base portion 13 to the grounded panel 15, but provides a grounding contact structure for any grounding application. For example, in one embodiment, the grounding contact enables secure connection for grounding of the cable sheath of a high amperage cable connector received by the receptacle 12 in the manner as will be explained in greater detail herein. While the description herein refers to mounting an electrical cable receptacle, it is understood that any like housing or structure for an device, electrical or otherwise, may be mounted using the combination mounting bolt and grounding member of the present invention.

By way of a non-limiting example, receptacle 12 includes a male or female single pole electrical connection dimensioned to mate with a corresponding female or male single pole connector device used for connecting electrical cabling of various sizes to a panel or housing. In one exemplary embodiment, such a male or female panel mounted receptacle mates with a corresponding female or male single pole connector device (such as an 1135 Amp single pole electrical connector) designed for mating cables sizes used for applications up to or exceeding the application for which they are intended. An example of such a rating is 1000 Volts AC or DC and up to 1135 amps continuous duty.

In the manner as now described herein below, an area of the mounting panel 15 reserved for locating a ground lug of the prior art grounding system of a high amperage cable connector is eliminated.

Figure 3:
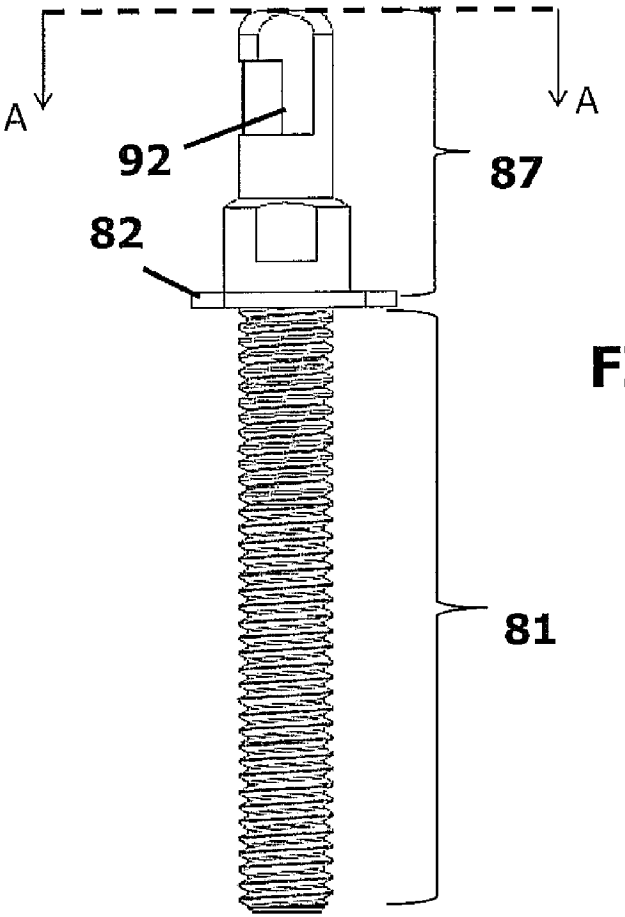
FIG. 3 is a longitudinal sectional view of the mounting/grounding member 75 according to one embodiment.

FIG. 3 shows a schematic of the mounting/grounding member 75 in one embodiment of the invention. The mounting/grounding member 75 is of unitary construction (although it does not have to be unitary construction), and, in one embodiment, comprises a conductive metal bolt.

As shown in FIG. 2 and the detailed view of combination grounding/mounting member 75 shown in FIG. 3, in one embodiment, combination grounding/mounting member 75 received within a receptacle aperture, e.g., aperture 17*d*, includes a first threaded portion 81 of length sufficient to extend beneath the underside of panel 15 for threaded engagement with suitable mounting assembly 90, e.g., heavy duty back nut(s), locking nut and washer(s), or some combination thereof, which engage threads of threaded first portion 81 for mounting non-conductive mounting base portion 13 of the receptacle 12 to panel 15. First portion 81 of member 75 is threaded having a length greater than at least the thickness of the aperture formed in the receptacle mounting base aperture and panel when the receptacle mounting base is fixedly secured to the panel.

Figure 6:
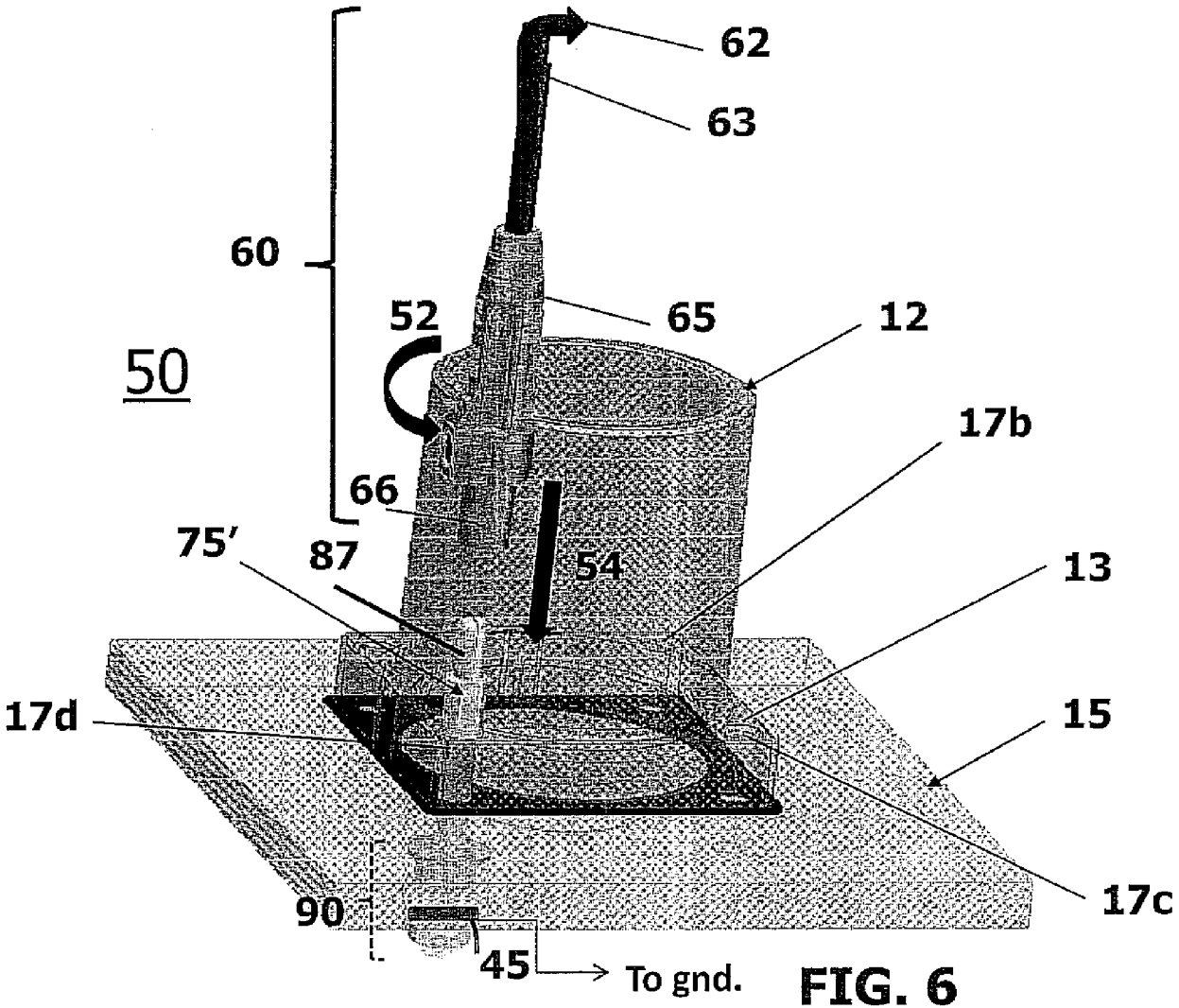
FIG. 6 illustrates a transparent three-dimensional view of a grounding assembly 50 for a mounted connector receptacle 10 including a mating connector 60 for connecting a high amperage cable sheath to a grounded contact portion of the combination mounting/grounding connector; and, FIG. 7 depicts a view of the electrical connection for grounding an insulative cable sheath of a high amperage cable.

In one embodiment, combination grounding/mounting member 75 includes a second connector portion 87 that extends above the receptacle base portion when the receptacle is mounted to the panel by mounting assembly 90 and includes flanged portion 82 that abuts the surface of the base portion of the receptacle when secured to the panel. This second connector portion 87 extending above the panel forms a male grounding contact when the mounting/grounding member 75 is coupled to electric ground underside the panel, for instance, by crimping or fastening a ground conductor lug or similar device 45 to first connection portion 81 of mounting/grounding member 75 underside the panel to an electrical ground (earth) as shown in FIG. 6. In this manner, the panel also becomes grounded. Although the second connector portion 87 extending above the panel forms a male grounding contact in the present embodiment, it can alternatively form a female grounding contact in another embodiment.

Figure 4A:
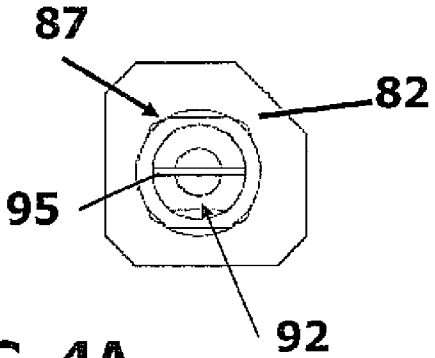
FIG. 4A is a top plan view taken along line A-A of FIG. 3 illustrating a male grounding contact 87 including a cam connector surface according to one embodiment.

In one embodiment, as shown in a top plan view of FIG. 4A, taken along line A-A of FIG. 3, the male grounded contact 87 includes a top portion having a lead-in cam surface 92, e.g., a cutaway or flat surface, such that, the second connector portion 65 of mating device 60 shown in FIG. 6, provides a cam fit, such as by turning the second connector portion 65 to engage male grounded contact 87. That is, the female connector of second connector portion 65 includes a cylinder or cylindrical type structure having a protuberance or raised pin (not shown) on an inside surface thereof adapted to slide fit along the flat 92 of grounding contact 87 to the location of a groove (not shown) whereupon a simple rotation brings the protuberance into a groove at a circumferential position from which it cannot be directly withdrawn without rotation, thus forming a cam action-type lock.

Figure 4B:
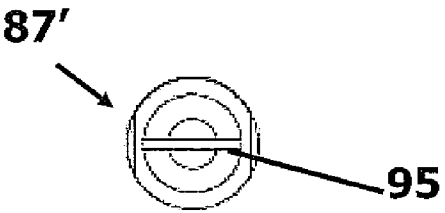
FIG. 4B is a top plan view taken along line A-A of FIG. 3 illustrating a male grounding contact 87' providing a non-cam connector surface according to an alternate embodiment.

In an alternate embodiment, as shown in a top plan view of FIG. 4B, the combination grounding/mounting member 75 includes a male grounded contact 87' that does not include a cam surface, i.e., the second connector portion 65 of mating device 60 provides a non-cam or slide-in or insertion fit to the top portion of grounding contact 87'.

In both embodiments, the male grounded contact 87 having a cammed contact surface 92 depicted in FIG. 4A, or having a non-cam contact surface in the case of grounded contact 87' depicted in FIG. 4B, there is provided a bifurcation in the form of a slot 95 to ensure provision of adequate (spring) pressure against the inside the female connector 65.

Figure 5:
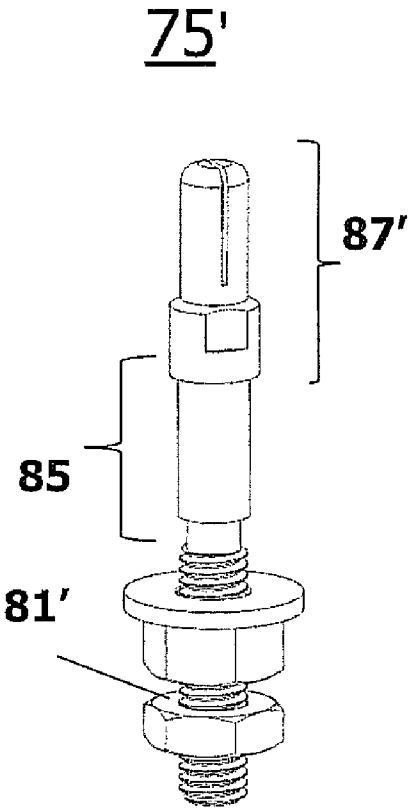
FIG. 5 illustrates longitudinal perspective view of a combination mounting/grounding member 75' including a non-cam connector surface according to an alternate embodiment.

FIG. 5 illustrates an alternate embodiment of the combination mounting/grounding connector shown in FIG. 3. In this alternate embodiment of the invention shown in FIG. 5, mounting/grounding member 75' is of like length dimension of mounting/grounding member 75 of FIG. 3, however, includes a shorter threaded first portion 81' designed to protrude the underside of the panel when fitted within receptacle mounting base aperture. Member 75' includes a non-threaded, cylindrical middle portion 85 of having a length commensurate with at least the thickness of the aperture formed in the receptacle mounting base aperture and panel when the receptacle mounting base is fixedly secured to the panel and, defines a male grounded contact 86 having a thicker diameter than that of non-threaded middle portion 85 to thereby abut against the surface of the receptacle mounting base when mounted to a panel.

As further depicted in FIG. 5, alternate member 75' provides a male grounded contact portion 87' having a non-cam surface as in the embodiment depicted in FIG. 4B, or, alternately the male grounded contact portion 87 has a cam surface 92 as in the alternate embodiment depicted in FIG. 4A. Further, male grounded contact 87 is provided with a bifurcation in the form of a slot 95 to provide a pressure fit within the inside the female connector 65 when engaged to ground a cable sleeve or sheath.

Figure 7:
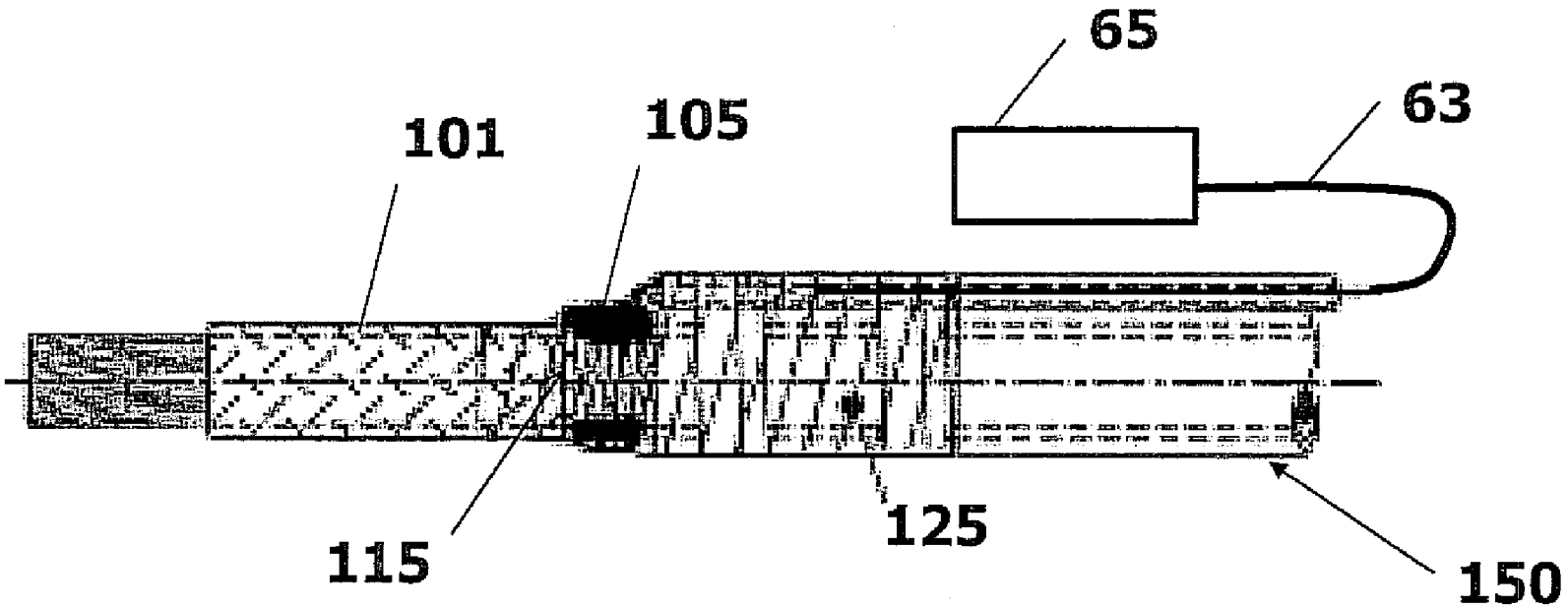

FIG. 6 is a transparent three-dimensional view of a grounding system or assembly 50 including a mating connector 60 for connecting, in an exemplary embodiment, a high amperage cable sheath, to a grounded contact portion of the combination mounting/grounding connector of the invention provided at the panel receptacle. The mating connector 60 according to an embodiment of the present invention, connects with the sleeve or sheath of a high amperage current carrying cable received at connector receptacle 10 and is electrically grounded via the mating connection to the grounded contact portion 87/87' of a grounding/mounting member 75 (FIG. 3) or, the grounding/mounting member 75' (FIG. 5). FIG. 6 further depicts the mating assembly 60 connected to grounding contact portion 87 of the mounting/grounding member 75'. As shown in FIG. 6, in one embodiment, the grounding assembly 60 for grounding the cable sheath includes a flexible grounding cable 63 (e.g., a # 3 or # 4 AWG wire) including a portion 62, configured to physically engage an insulating sheath or sleeve of a cable (e.g., a high amperage cable). For example, in one embodiment, first connector portion 62 connects to a high amperage cable sleeve or sheath as follows: the flexible grounding cable 63 is first connected, e.g., adhered such as by electrical tape and/or wrapped together with a heat shrink tube, to the high amperage cable. At or near an end of the adhered flexible grounding cable 63, a portion of the high amperage cable is exposed, e.g., by cutting back the outer sheath of jacket of the high amperage cable to expose a pre-determined length if the insulative braided armor shielding, for instance. FIG. 7 illustrates a length of exposed braided armor shielding 101 of the high amperage cable 150. Then, the grounding cable 63 is cut to remove a portion of its insulative jacket to expose grounding cable wire strands 115 at a length sufficient to wrap around the exposed braided armor shielding 101. These strands 115 are then tightly wrapped around the jacket-braided armor shielding 101 and soldered or otherwise affixed to the insulative braided armor shielding, e.g., at solder points 105. An electrical tape, rubber or other material tape 125 may be used to wrap the finished connection and the grounding cable strands 115 against the main high amperage cable. Optionally, or in addition, the heat shrink wrap may be provided over the taped connection and heated in place. Other embodiments, may entail embedding a conductive lug connected to the flexible grounding cable in the surrounding cable sheath so as to contact the braided armor shielding. In either embodiment, the connector grounding cable 63 includes a termination portion 65 designed to mate with the grounding/mounting connector.

Particularly, the termination portion 65 of grounding assembly 60 for grounding the cable sheath includes, in one embodiment, a female connector 66 designed to electrically couple to the male grounded contact 87, 87' of mounting/grounding member 75, 75'. In one embodiment, as shown in FIG. 6, when intended for use in high power conditioning and power transfer applications, such as required for the oil rig, advantageous grounding of the sheath is accomplished by simply coupling the single pole non-cam (or cam-type in an alternate embodiment) female connector 66 (such as the aforementioned 1135 Amp single pole single pole cam or non-cam electrical connector product) to the respective male grounded contact 87 (depicted in FIG. 4A) by a simple rotation manipulation 52 (as shown by the arrow), or to the alternate male grounded contact 87' (depicted in FIG. 4B) by a simple insertion manipulation 54.

It is understood that in either embodiment, whether the female connector 66 is a single pole cam or non-cam type connector manipulated to fit a respective male grounded contact 87 in a first embodiment depicted in FIG. 4A, or alternate male grounded contact 87' depicted in FIG. 4B, a secure electrical ground connection that is more resistant to vibrations and noise is formed.

Figure 1:
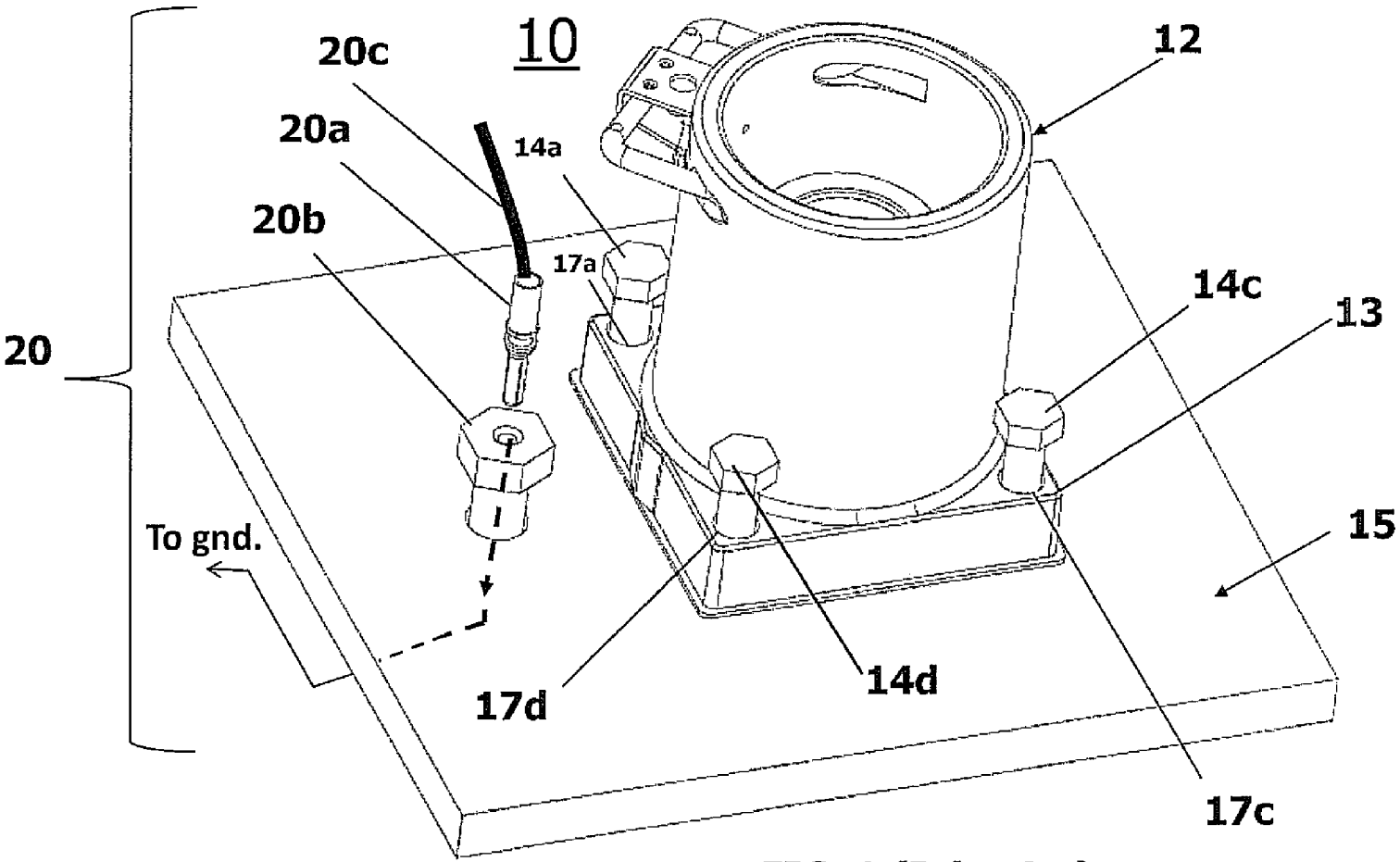
FIG. 1 (Prior Art)
FIG. 1 a diagram of a panel mounted receptacle for a single pole electrical connector in accordance with the prior art.

Thus, in one application, by use of the invention, electrical grounding needs of a high amperage cable's insulating sleeve or sheath is satisfied, especially at field installations in harsh industrial environments, e.g. an oil production rig, where there is need for secure, rugged equipment. For example, oil rig installations include electrical generation equipment, e.g., generators that provide power to electro-mechanical assemblies including, but not limited to: top drive motor(s) and mud pump(s), and include other power signal conditioning equipment, e.g., silicon controlled rectifier (SCR) drives, typically housed in an enclosure, that perform AC to DC power conversion. Such drive equipment typically includes banks of male or female panel mounted receptacles each bolt-mounted to the panel as shown in FIG. 1 and receiving a high power cable connector. Insulating sleeve and sheath grounding solutions can be employed by use of the present invention to mitigate electrical disturbances caused by the high power electrical generation and signal conditioning equipment that are a source of unwanted electrical interference including harmonics and distortion on the power cable lines found to cause interference (feedback and noise) in the sensitive control electronics controlling the operation of the drive and pump motors.

Though the combination grounding/mounting connector (bolt) of the invention has been shown and described for mounting the high amperage connector receptacle 10 to a panel or backboard, it is understood that the combination grounding/mounting connector can be used in any electrical apparatus. In the embodiments illustrated, the combination grounding/mounting connector is designed to replace one of the mounting bolts typically used in the field. By using an embodiment of this invention, the grounding of the sheath of a high amperage cable doesn't take up any additional space on the panel and the connection can be made simply and quickly without the need for any additional hardwiring.

The present invention can be used for mounting panel mounted receptacles that accommodate a electrical cable connection primarily for AC to DC power conversion and power transfer, e.g., from the electrical generator to power motors and drives of large electro-mechanical assemblies, e.g., in oil rigs, nuclear plants, power distribution facilities or plants, amusement parks, carnivals, or any application where there is needed a mobile unit for high power distribution or power transfer.

Thus, in a further aspect of the invention, there is provided a grounding system and method for providing a grounding system for panel mounted receptacles that accommodate an electrical cable connection. More particularly, the method of the present invention enables the grounding of a cable sheath of a high current carrying cable. The method includes: affixing an electrical connector to a panel with a connector; coupling a first portion of said connector to an electrical ground; electrically connecting a cable sheath of the high current carrying cable received at the electrical connector for receipt at a top portion of the grounded connector.

The electrically connecting of the high current carrying cable to a top portion of the grounded connector via the flexible grounding cable having a terminating female mating connector includes rotating the female connector to form a cam action lock with the connector top portion. Alternately, the electrically connecting of the high current carrying cable to a top portion of the grounded connector via the flexible grounding cable having a terminating female mating connector includes fitting said female connector to the top portion.

Although a few examples of the present invention have been shown and described, it would be appreciated by those skilled in the art that changes might be made in these embodiments without departing from the principles and spirit of the invention, the scope of which is defined in the claims and their equivalents.

What is claimed is:

1. A conductive electrical grounding member comprising:

a first portion adapted to mount a housing to a surface, said first portion is threaded and adapted to receive an electrical ground lug and fastener; and a second portion adapted to mate with a mating connector, the second portion is one of a single-pole male or female single-pole cam connector, wherein said second portion includes a groove and the mating connector includes a cam connector having a protuberance formed thereon, whereupon a rotation brings the protuberance of said cam connector into said groove at a circumferential position, the groove guiding the cam connector to provide a cam-action securement from which it cannot be withdrawn without rotation.

2. The electrical grounding member as claimed in claim 1, wherein said second portion includes a bifurcated distal portion disposed to provide a pressure fit to the mating connector.

3. The electrical grounding member as claimed in claim 1, wherein said grounding member comprises a bolt of unitary construction.

4. The electrical grounding member as claimed in claim 1, further comprising a flange disposed to abut said surface of the housing when mounted.

5. A grounding system for a cable sheath comprising:

a grounding member disposed to mount a housing to a surface, said grounding member having a portion disposed to extend through at least a portion of the housing to engage a fastener to mount said housing to said surface, and adapted to couple to an electrical ground, said grounding member including a single-pole cam connector portion; and, a termination device including a cam connector disposed to mate with and electrically connect said cable sheath to said single-pole cam connector portion, wherein said single-pole cam connector portion includes a groove disposed to guide said cam connector, said cam connector having a protuberance thereon, whereupon a rotation brings the protuberance of said cam connector into said groove at a circumferential position to provide a cam-action securement from which it cannot be withdrawn without rotation.

6. The grounding system for a cable sheath as claimed in claim 5, further comprising a grounding cable connected between the termination device and the cable sheath.

7. The grounding system for a cable sheath as claimed in claim 5, wherein said grounding member portion extending to engage said fastener is threaded, said fastener is disposed to cooperate with a grounding lug and a nut to securely fasten said housing and the grounding lug to said surface.

8. The grounding system for a cable sheath as claimed in claim 5, where the housing further comprises an area footprint occupied by the housing on the surface and the grounding member portion which is disposed to extend through at least a portion of the housing extends through at least a portion of the housing completely within the area footprint.

9. A method for grounding a cable sheath of a cable comprising:

affixing a housing to a surface with a member;

placing an electrical ground lug over a first portion of said member;

threading a nut onto said first portion of said member to secure said electrical ground lug and said housing to said surface;

connecting a cable sheath to a single-pole cam connector; and mating the single-pole cam connector to a single-pole cam connector portion of the member, wherein said single-pole cam connector portion includes a groove disposed to guide said cam connector, said cam connector having a protuberance thereon, said mating including: rotating said cam connector to bring the protuberance of said cam connector into said groove at a circumferential position to provide a cam-action securement from which it cannot be withdrawn without rotation.

10. The method as claimed in claim 9, wherein said electrically connecting a cable sheath includes:

affixing a conductive cable to a layer of said current carrying cable, said conductive cable including conductive wire strands;

removing a layer of said current carrying cable to expose an insulative shield; and, affixing said conductive wire strands to said insulative shield to form an electrical connection.

11. A bolt disposed to mount and ground a panel mount housing to a panel comprising:

a threaded portion disposed to extend though a mounting hole of the housing and receive a grounding connection and a fastener;

a single-pole cam connector portion disposed to mate with a single-pole cam connector connected to a cable sheath;

where the threaded portion and the fastener secure and electrically bond the housing and the grounding connection to the panel, and, wherein said single-pole cam connector portion includes a groove and the single-pole cam connector includes a protuberance formed thereon, whereupon a rotation brings the protuberance of said single-pole cam connector into said groove at a circumferential position, the groove guiding the cam connector to provide a cam-action securement from which it cannot be withdrawn without rotation.

12. The bolt as claimed in claim 11, wherein the housing is a portion of a single-pole connector having an 1135 Amp current carrying capacity and is disposed to mate with a mating connector attached to a power cable; the cable sheath surrounding the power cable.

* * * * *